United States Patent [19]

Tanaka et al.

[11] Patent Number: 4,779,084

[45] Date of Patent: Oct. 18, 1988

[54] APPARATUS FOR GENERATING MEMORY ADDRESS OF A DISPLAY MEMORY

[75] Inventors: Toshio Tanaka; Hiroyuki Sakai, both of Yokohama; Nobuo Shibasaki, Kodaira, all of Japan

[73] Assignee: Hitachi, Ltd., Tokyo, Japan

[21] Appl. No.: 15,015

[22] Filed: Feb. 17, 1987

[30] Foreign Application Priority Data

Feb. 21, 1986 [JP] Japan ..... 61-35000

[51] Int. Cl.[4] ..... G09G 1/16

[52] U.S. Cl. ..... 340/799; 340/724; 340/730; 340/747

[58] Field of Search ..... 340/799, 730, 747, 723, 340/724, 750

[56] References Cited

U.S. PATENT DOCUMENTS 4,356,482 10/1982 Oguchi ..... 340/799
4,364,037 12/1982 Walker ..... 340/799
4,368,466 1/1983 Dwire ..... 340/799
4,688,033 8/1987 Carini et al. ..... 340/799

*Primary Examiner*—Howard A. Birmiel
*Attorney, Agent, or Firm*—Antonelli, Terry & Wands

[57] ABSTRACT

A memory address signal for a display memory is generated from a memory address generating circuit. The memory address generating circuit has an offset register and a memory address counter in addition to a memory address register. The offset register stores an offset value corresponding to a difference between a width of the display memory and a width of a display picture in a scanning direction. The memory address counter counts up a character clock in order to deliver the memory address signal after loading a start address of each horizontal scanning line of the display picture. At the end of each horizontal scanning line, an adder adds the offset value to the memory address signal. The addition thereof is loaded into the address register as the start address of the next horizontal scanning line.

11 Claims, 4 Drawing Sheets

1 LINE DISPLAY
FIG. 2A CHARACTER CLOCK 18
FIG. 2B DISPLAY TIMING SIGNAL 9
BLANKING PERIOD
FIG. 2C DETECTION SIGNAL OF HTDC (H)
FIG. 2D ADDER SIGNAL 24
FIG. 2E MAR LOAD SIGNAL 22
FIG. 2F MAC LOAD SIGNAL 23
FIG. 2G MAR 16
0
0
24
FIG. 2H MAC 17
0
1
2
15
16
17
18
24
1 FIELD
FIG. 2I DISPLAY TIMING SIGNAL 9
FIG. 2J MAR LOAD SIGNAL 22
FIG. 2K MAC LOAD SIGNAL 23
FIG. 2L SELECTOR SIGNAL 25
FIG. 2M MAR 16
0
24
24 x (n-1)
0
n : LINE NUMBER

APPARATUS FOR GENERATING MEMORY ADDRESS OF A DISPLAY MEMORY

BACKGROUND OF THE INVENTION

The present invention relates to an apparatus for generating memory address signals supplied to a display memory for reading out image data recorded in the display memory, especially, an apparatus for generating memory address signals preferable to a panning of a display picture on a display apparatus, where the width of the display memory is larger than the width of the display picture.

In the prior art, for example, as described in Japanese Laid-Open Patent Application No. 57-56885, 1982, an apparatus for generating a memory address signal has a memory address register for memorizing a memory address, a count register, which is cleared at the end of each display line and a pitch register for memorizing an address number in the scanning direction of the display memory. Usually, the memory address signal is calculated by adding the contents of the memory address register and the count register. At the end of each display line, the addition of the contents of the memory address register and the pitch register, is supplied as the memory address signal and stored in the memory address register. In this method, the memory address signal is calculated at each character clock and provided to the display memory.

In general, the display apparatus has come reached to a level of higher resolution. As a result, it has become necessary to make display speed higher. Therefore, according to the above method, in which the calculation is excuted at each character clock, the display speed depends on calculation ability of a processor, so that it is difficult to attain higher display speed. Further, if the processor is fabricated by a complementary metal oxide semiconductor integrated circuit (CMOSIC), the processor operates each character clock, so that it is difficult to reduce power consumption.

SUMMARY OF THE INVENTION

It is an object of the present invention to provide an apparatus for generating a memory address of a display memory preferably for executing a panning of a display picture.

It is another object of the present invention to provide an apparatus for generating a memory address signal of a display memory, which has high display speed without a high speed precursor and low power consumption.

In order to attain the above objects, according to the present invention, an offset register and a memory address counter are used in an apparatus for generating a memory address of a display memory. The offset register stores an offset value, which corresponds to a difference between a width of the display memory and a width of a display picture in a horizontal scanning direction, which is set from a CPU. In the apparatus of the present invention, the offset value is added to the content of the memory address counter only at the end of each horizontal line in order to obtain a start memory address of the next horizontal line.

As a result, a number of additions are reduced, so that it becomes possible to attain a panning without a high speed adder or processor.

DETAILED DESCRIPTION OF THE PREFERRED EMBODIMENTS

Preferred embodiments will be explained in accordance with attached drawings, hereinafter.

Figure 3:
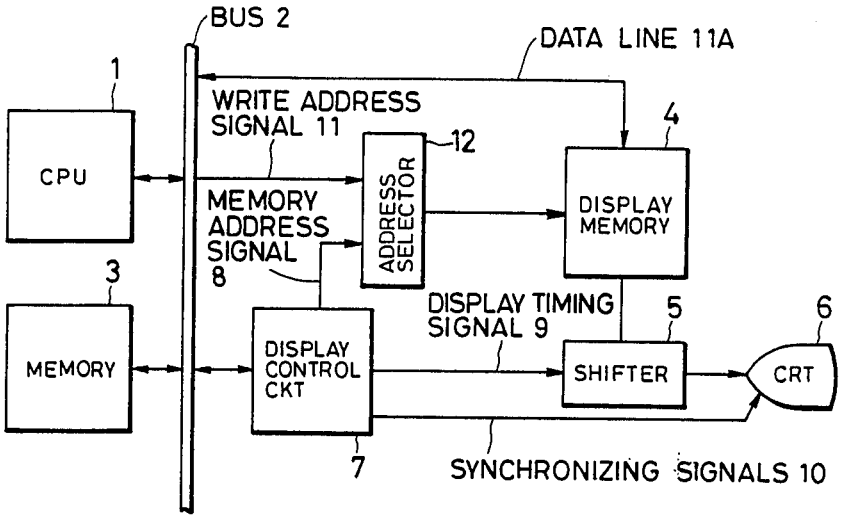
FIG. 3 shows a block diagram of an embodiment of a display system of the present invention.

FIG. 3 shows a block diagram of a display system having a memory address generating circuit of the present invention.

Referring to FIG. 3, a central processing unit 1 (hereinafter, abbreviated to CPU) is connected via a bus 2 to a memory 3 storing a processing program and working data and a display memory 4 storing image data. Also, the CPU1 is connected via a bus 2 to a display control circuit 7 for reading out the contents of the display memory 4 and displaying a character and a pattern in a cathode ray tube (hereinafter, abbreviated to CRT) together with a shifter (serializer) 5. The display control circuit 7 generates a memory address signal 8 for reading out image data and a plurality of timing signals necessary to display the image on the CRT6, for example, a display timing signal 9 and horizontal and vertical synchronizing signals of the CRT6.

The memory address signal 8 is supplied to an address selector 12 together with a write address signal 11 for the display memory 4 generated from the CPU1. The address selector 12 selects the memory address signal 8 in a normal display mode and the write address signal 11 in a write mode of the display memory 4, in which the CPU delivers image data via a data line 11A. The shifter 5 converts parallel data read out from the display memory 4 to serial data and supplies it to the CRT6.

The display control circuit 7 supplies the memory address signal 8 to the display memory 4 so that the display data is read out from the display memory 4 and provided via the shifter 5 to the CRT6. The circuit 7 is provided with a plurality of parameters necessary for display via the bus 2 from the CPU1, which will be explained later.

Figure 4:
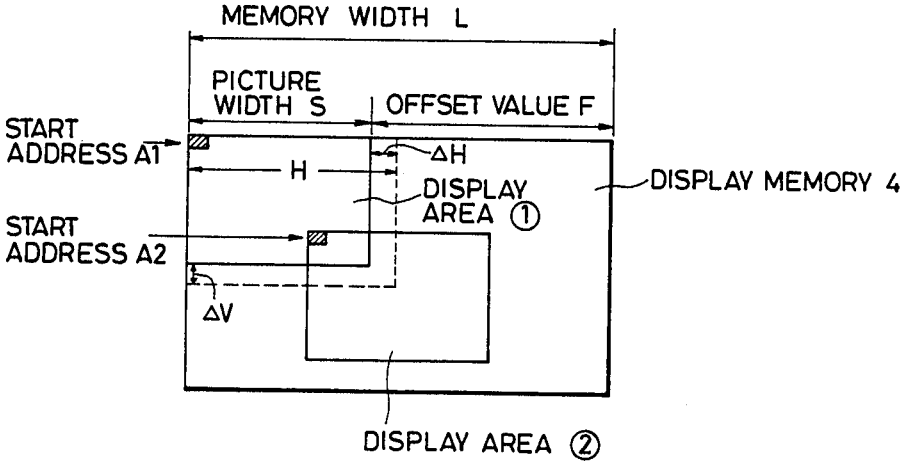
FIG. 4 illustrates a schematic diagram for explaining relation between a display memory and display area in the present invention.

Referring to FIG. 4, the display memory 4 has a memory area broader than display area 1 or 2, which corresponds to a picture displayed on the CRT6. In this situation, assume that the width of the display memory 4 in terms of a display character unit is L, the width of the displayed picture in terms of the display character unit is S and the difference of them is F. In the present invention, the value F is called an offset value. This offset value F is set into an offset register, and will be explained in greater detail later. For example, when the width S is 80 and the width L is 128, the offset value F is equal to 48.

It is apparent that the offset value F is constant, even if the display area is moved from 1 to 2. In order to display the display area 1 on the CRT6, a start address A1 is set into the circuit 7 from the CPU1, a first line is scanned in the horizontal direction until the right edge of the display area 1 is reached. When the end of the scanning of the first line is reached, the offset value F is added to the memory address of the terminal point of the first line in order to get the memory address of the start point of the second line thereof. By repeating this process, the memory address signals necessary for scanning the display area 1 can be sequentially obtained.

In this method, when the start address is changed from A1 to A2 in accordance with an instruction of the CPU1, the panning in the horizontal direction or the diagonal direction can be established. Further, with respect to other essential parameters for display, a number of horizontal display characters corresponding to the width of the display picture and a number H of horizontal total display characters which contains a horizontal blanking period ΔH are set into inner registers of the display control circuit 7 by the CPU1. In FIG. 4, ΔV indicates a vertical blanking period.

Figure 1:
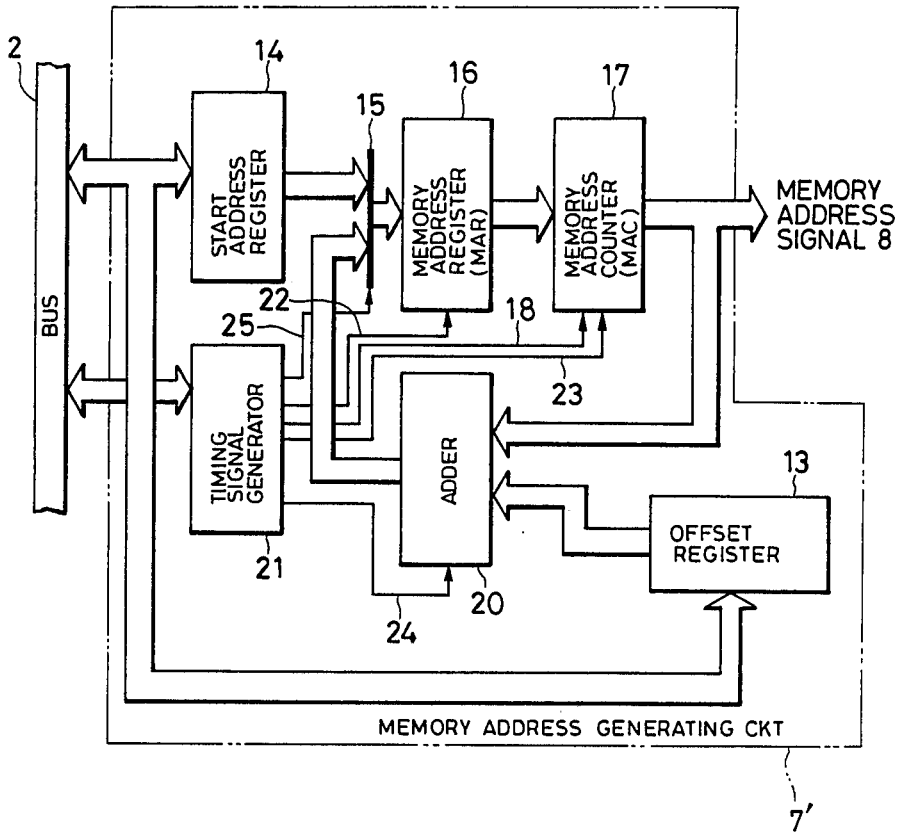
FIG. 1 shows a block diagram of an embodiment of a memory address generating circuit of the present invention.

FIG. 1 shows a block diagram of a memory address generating circuit 7′ of the embodiment of the present invention. The memory address generating circuit 7′ is a main part of the display control circuit 7 shown in FIG. 4. Referring to FIG. 1, the numerals 13 to 17 denote an offset register, a start address register, a selector, a memory address register (MAR) and a memory address counter (MAC), respectively. Further, the numerals 20 and 21 designate an adder and a timing signal generator, respectively. The offset value is set into the offset register 13 via the bus 2 from the CPU1. Also, the start address, for example, A1 of the display area 1 , is set into the start address register 14 via the bus 2 from the CPU1. The output data of the selector 15, which is the output data of the start address register 14 or the output data of the adder 20, is supplied to the MAR16. The data provided to the MAR16 is loaded into the MAC17. The MAC17 counts up character clocks 18 based on the loaded data. Each of the character clocks 18 corresponds to a character unit and is supplied from the timing signal generator 21. As a result, the memory address signal 8 is sequentially generated and supplied to the display memory 4 via the address selector 12 shown in FIG. 3.

Assume the value of the offset register 13 is "8" and the value of the MAC17 is "16" at the end of the first scanning line, the adder 20 adds "8" and "16", and supplies the addition "24" into the MAR16 as the start address of the next line.

The timing signal generator 21 generates a MAR load signal 22, a MAC load signal 23, an adder signal 24, a selector signal 25 and the character clock 18 at the predetermined timings, as being explained in detail later.

FIGS. 2A to 2M illustrate waveforms of main signals of the embodiment shown in FIG. 1. The waveforms shown in FIGS. 2I to 2M are depicted in a reduced time scale in comparison with the waveforms of FIGS. 2A to 2H in order to explain the operation of one field period. Further, in the example shown in FIGS. 2A to 2M, the value set into the start address register 14 is "0", the number S of the horizontal display character is "16", the blanking period in the character unit is "3", the number H of the horizontal total display character is therefore "19", and the value set into the offset register 13 if "8".

Figure 2:
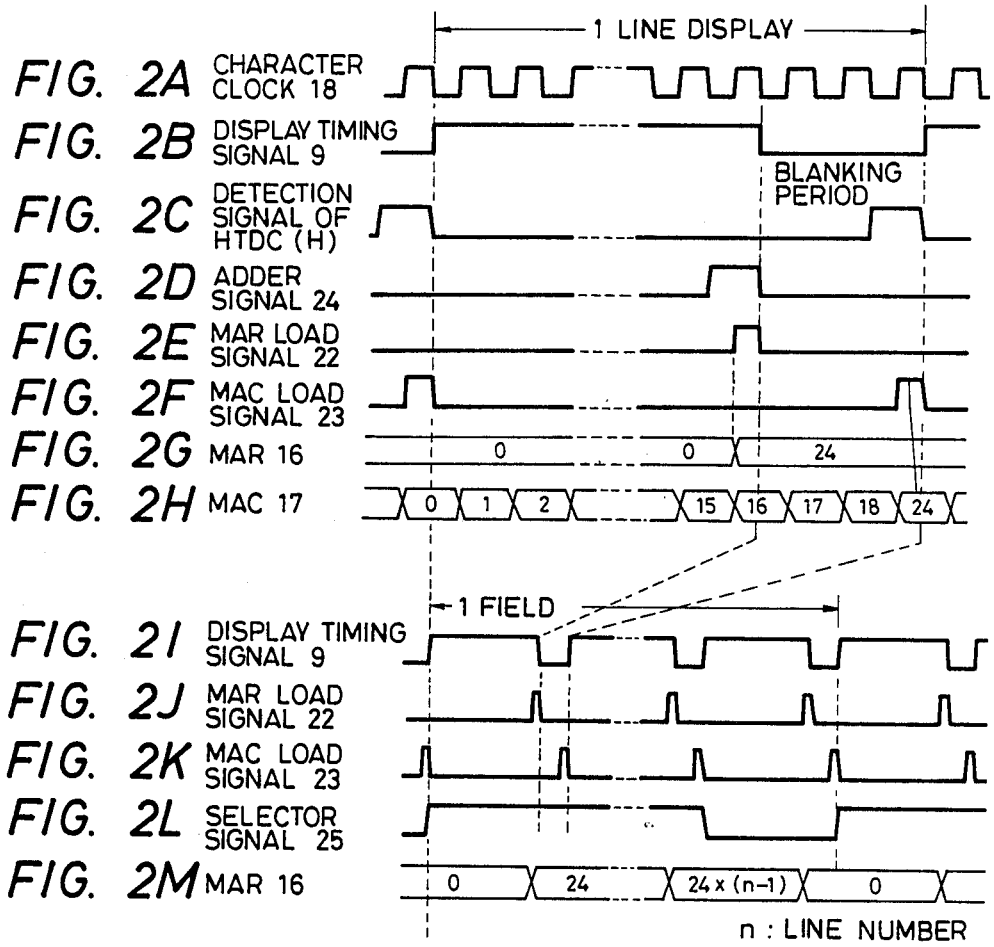
FIGS. 2A to 2M illustrate signal waveforms of main parts of the circuit shown in FIG. 1, respectively.

First, the start address "0" stored in the start address register 14 is set into the MAR16 via the selector 15, when the selector signal 25 delivered from the timing signal generator 21 is "0" level, that is, at one line display period just prior to the end of one field, as shown in FIG. 2L. The set timing coincides with the MAR load signal 22 generated from a detection signal of the number S of the horizontal display characters just prior to the end of the display period, as shown in FIGS. 2D, 2E, 2J and 2M.

Next, the content of the MAR16 is loaded into the MAC17 in response to the MAC load signal 23 generated from a detection signal of the number H of the horizontal total display characters just prior to the end of the horizontal blanking period, as shown in FIGS. 2C and 2F. In this example, "0" is loaded, but this value is arbitrarily set into the start address register 14 by the CPU1 in order to execute the panning.

The MAC17 sequentially counts up the character clocks 18 from the timing signal generator 21 to generate the memory address signal 8. During the normal mode, only the memory address counter 17 counts them up in order to generate the memory address signal 8.

Next, when the detection signal of the number S of the horizontal display characters is obtained, this signal is used as the adder signal 24, so that the data of the offset register 13 and memory address counter 17 are added at the adder 20. In this example, at the end of the first line, the added value "24", which is equal to "8" plus "16", is obtained, L provided to the MAR16 via the selector 15, and loaded into the MAR16 as the start address of the next line. Further, this value "24" is set into the MAC17 by the MAC load signal 23.

By the same process, at the end of the next line, the addition of "24", "16" and "8" is executed by the adder 20. As a result, the memory address signals necessary for displaying a picture are sequentially generated from the memory address generating circuit 7′.

During the display period of the last line of one field, the selector signal 25 is changed from a high level to a low level, so that the data of the start address register 14 is loaded in the MAR16. Therefore, the display address can be generated at the start of the next field.

Figure 5:
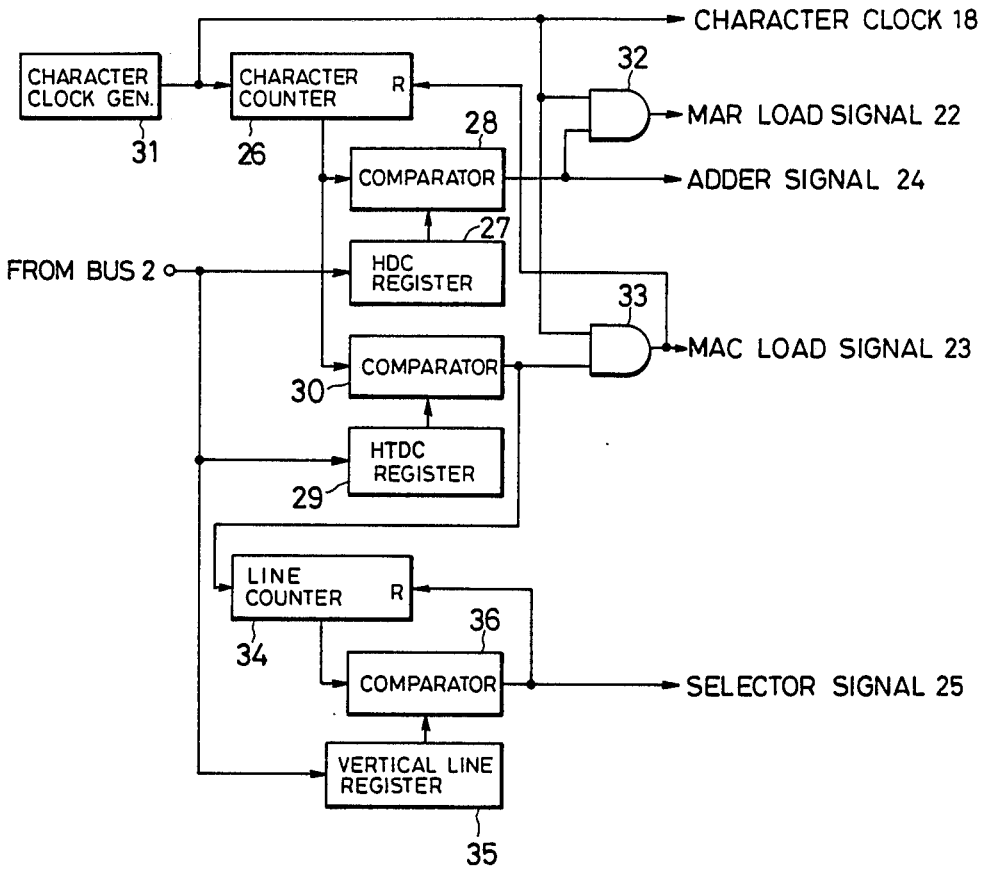
FIG. 5 shows a block diagram of an embodiment of a timing signal generator 21 shown in FIG. 1.

FIG. 5 shows a block diagram of an embodiment of the timing signal generator 21 shown in FIG. 1. The character clock 18 is generated from a character clock generator 31. This clock is used as a reference indicating the character unit. A character counter 26 counts the character clock 18 and supplies an output signal to comparators 28 and 30. The comparator 28 compares the output signal with data stored in a horizontal display character (HDC) register 27. The comparator 30 compares the output signal with data stored in a horizontal total display character (HTDC) register 29. These data are arbitrarily supplied from the CPU1 via the 20 CPU bus 2. These data determine a display area and a scanning period in the horizontal direction. The adder signal 24 as the output signal of the comparator 28 is generated when the counted value of the character counter 26 coincides with the set data of the HDC register 27. The adder signal 24 has a pulse width corresponding to one character clock. Further, the character clock 18 and the adder signal 24 are provided to an AND circuit 32, which generates the MAR load signal 22 having a latter half width of the adder signal 24.

In contrast, an output signal of the comparator 30 is generated when the counted value of the character counter 26 coincides with the set data of the HTDC register 29. This output signal and the character clock 18 are provided to an AND circuit 33, which generates the MAC load signal 23. The MAC load signal 23 is also used as a reset pulse of the character counter 26. Namely, the character counter 26 is initialized, when the count value becomes the number of the HTDC. Further, the output signal of the comparator 30 corresponding to one horizontal scanning period is used as a count clock of a vertical line counter 34, which counts a number of lines in the vertical direction. Also, a vertical line register 35 receives a set data from the CPU1 via the CPU bus 2. The set data thereof corresponds to a number of vertical lines of the display picture. Another comparator 36 compares the count value of the line counter 34 with the data of the vertical line register 35 and generates the selector signal 25, when the count value coincides with the data. Also, this selector signal 25 is used for resetting the line counter 34.

As mentioned above, the timing signal generator 21 shown in FIGS. 1 and 5 does not have functions to produce the display timing signal 9 and the synchronizing signals 10 shown in FIG. 3. However, the display timing signal 9 is simply generated by using the MAC load signal 23 and the adder signal 24. For example, a flip flop circuit, which turns on and off at the trailing edges of the both signals, can produce the display timing signal 9. Also, a person having ordinary skill in this technical area can easily construct a circuit for generating the synchronizing signals 10. Therefore, the explanation thereof is omitted.

In the embodiment described above, the timing chart is explained in a case that a character line is constructed by a scanning line. However, even if the character line is constructed by a plurality of scanning lines, for example, eight scanning lines, the present invention is useful. In that case, only when the last scanning line is scanned at each character line, the above mentioned timing control has to be executed.

Further, since the horizontal blanking period is usually several or several tens character units, it is possible to shift the MAR load signal near to the MAC load signal, so that the adder 20 can execute the additions more slowly.

As mentioned above, in the present invention, since the execution of the addition is less than one during each horizontal scanning, it becomes possible to reduce power consumption by using CMOS-IC. Also, according to the present invention, it becomes possible to provide an apparatus for generating memory address without a high speed adder or processor.

What is claimed is:

1. An apparatus for generating a memory address signal of a display memory to read out display data stored therein, comprising:

memory address register means for loading therein a start address of each horizontal scanning line of a display picture;

memory address counter means for counting a character clock after loading therein said start address of each horizontal scanning line loaded in said memory address register means so as to generate the memory address signal;

offset register means for storing an offset value corresponding to a difference between a width of said display memory and a width of said display picture in a scanning direction; and adder means for providing an output value corresponding to the addition of said offset value and said memory address signal at the end of said each horizontal scanning line and providing said output value as said start address of a next horizontal scanning line to said memory address register means.

2. An apparatus according to claim 1, further comprising:

start address register means for receiving said start address of the first horizontal scanning line of a field from a central processing means via a bus and storing it.

3. An apparatus according to claim 2, further comprising:

selector means coupled to said memory address register means for selecting one of the content of said start address register means and the output value of said adder means.

4. An apparatus according to claim 3, further comprising:

timing signal generator means for providing a selector signal to said selector means and load signals to said memory address register means and said memory address register means.

5. An apparatus according to claim 4, further comprising:

means for selectively applying said memory address signal generated by said memory address counter to said display memory during a normal display mode.

6. An apparatus according to claim 1, wherein the width of said display memory being greater than the width of said display picture.

7. An apparatus for generating a memory address signal of a display memory to read out display data of a display picture, comprising:

a central processing unit;

start address register means coupled to said central processing unit via a bus for storing a start address of a first horizontal scanning line of said display picture;

selector means for transmitting address data therethrough and having a first input terminal connected to said start address register means, a second input terminal and an output for providing said address data;

memory address register means coupled to said output terminal of said selector means for loading therein said output data of said selector means;

memory address counter means coupled to said memory address register means for counting a character clock after transferring said output data of said selector means therein in order to generate the memory address signal;

offset register means for storing an offset value corresponding to a difference between a width of said display memory and a width of said display picture in a horizontal scanning direction; and adder means for providing an output value corresponding to the addition of said offset value and the memory address signal at the end of each horizontal scanning line and providing said output value via said second input terminal of said selector means to said memory address register as said start address of a next horizontal scanning line.

8. An apparatus according to claim 7, further comprising:

timing signal generator means for providing a selector signal to said selector means, wherein;

said selector means selects the content of said start address register means at the end of scanning said display picture in response to said selector signal.

9. An apparatus according to claim 8, wherein said timing signal generator means further provides load signals to both said memory address register means and said address register means.

10. An apparatus according to claim 9, further comprising:

means for selectively applying said memory address signal generated by said memory address counter to said display memory during a normal display mode.

11. An apparatus according to claim 7, wherein the width of said display memory being greater than the width of said display picture.

* * * * *